US011840856B1

(12) United States Patent
Ford

(10) Patent No.: US 11,840,856 B1
(45) Date of Patent: Dec. 12, 2023

(54) TREE CLIMBING TARP SECURING CUFF

(71) Applicant: Melina Ford, Lindsay (CA)

(72) Inventor: Melina Ford, Lindsay (CA)

( * ) Notice: Subject to any disclaimer, the term of this patent is extended or adjusted under 35 U.S.C. 154(b) by 165 days.

(21) Appl. No.: 17/666,648

(22) Filed: Feb. 8, 2022

(51) Int. Cl.
*E04H 15/04* (2006.01)

(52) U.S. Cl.
CPC ..... *E04H 15/04* (2013.01)

(58) Field of Classification Search
CPC ..... E04H 15/04
See application file for complete search history.

(56) References Cited

U.S. PATENT DOCUMENTS

| | | | | |
|---|---|---|---|---|
| 7,383,597 | B2 * | 6/2008 | Steiner | A45B 3/00 5/121 |
| 7,997,311 | B2 | 8/2011 | Prout, Jr. | |
| 8,517,066 | B1 | 8/2013 | DeMortel et al. | |
| 8,657,071 | B2 * | 2/2014 | Curry | A01M 31/02 248/219.3 |
| 8,978,792 | B2 | 3/2015 | Fauroux | |
| 9,051,753 | B1 | 6/2015 | Zamipour | |
| D751,355 | S | 3/2016 | Vizachero | |
| 9,314,090 | B1 * | 4/2016 | Manning | E04H 15/04 |
| 9,370,142 | B2 * | 6/2016 | Barnhill | B25J 9/0009 |
| 9,526,208 | B2 | 12/2016 | Zamirpour | |
| 10,765,184 | B2 | 9/2020 | York | |
| 2014/0014150 | A1 * | 1/2014 | Horner | E04H 15/04 135/90 |

FOREIGN PATENT DOCUMENTS

| | | |
|---|---|---|
| WO | 2014031391 | 2/2014 |

* cited by examiner

*Primary Examiner* — Noah Chandler Hawk
(74) *Attorney, Agent, or Firm* — Kyle A. Fletcher, Esq.

(57) ABSTRACT

The tree climbing tarp securing cuff includes a tree cuff, a plurality of wheels, a plurality of motors, a motor controller, and a receiver. The tree cuff may climb a trunk of a tree to elevate an end of a rope that is removably coupled to the tree cuff. The plurality of wheels may be exposed on the interior of the tree cuff and may be turned by the plurality of motors to propel the tree cuff up and down the trunk. The tree cuffs may be used in groups to suspend a tarp via a plurality of ropes. As non-limiting examples, the tree cuffs may suspend the tarp higher than a user can reach to provide shade or to keep rain off of a tent or a picnic table.

19 Claims, 5 Drawing Sheets

TREE CLIMBING TARP SECURING CUFF

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of outdoor gear and camping gear, more specifically, a tree climbing tarp securing cuff.

SUMMARY OF INVENTION

The tree climbing tarp securing cuff comprises a tree cuff, a plurality of wheels, a plurality of motors, a motor controller, and a receiver. The tree cuff may climb a trunk of a tree to elevate an end of a rope that is removably coupled to the tree cuff. The plurality of wheels may be exposed on the interior of the tree cuff and may be turned by the plurality of motors to propel the tree cuff up and down the trunk. The tree cuffs may be used in groups to suspend a tarp via a plurality of ropes. As non-limiting examples, the tree cuffs may suspend the tarp higher than a user can reach to provide shade or to keep rain off of a tent or a picnic table.

An object of the invention is to removably couple a tree cuff to the trunk of a tree by hingedly opening two halves of the tree cuff and closing the two halves of the tree cuff to surround the trunk.

Another object of the invention is to removably couple one end of a rope to the tree cuff and the opposite end of the rope to a corner of a tarp.

A further object of the invention is to provide a plurality of wheels that are exposed at a tree aperture within the tree cuff and are in contact with the trunk of the tree.

Yet another object of the invention is to propel the tree cuff up and down the tree trunk by energizing a plurality of motors to rotate the plurality of wheels that are in contact with the tree trunk, thus raising and lowering the corner of the tarp.

An object of the invention is to use multiple tree cuffs under the control of a remote control unit to raise and lower a tarp.

These together with additional objects, features and advantages of the tree climbing tarp securing cuff will be readily apparent to those of ordinary skill in the art upon reading the following detailed description of the presently preferred, but nonetheless illustrative, embodiments when taken in conjunction with the accompanying drawings.

In this respect, before explaining the current embodiments of the tree climbing tarp securing cuff in detail, it is to be understood that the tree climbing tarp securing cuff is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tree climbing tarp securing cuff.

It is therefore important that the claims be regarded as including such equivalent construction insofar as they do not depart from the spirit and scope of the tree climbing tarp securing cuff. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
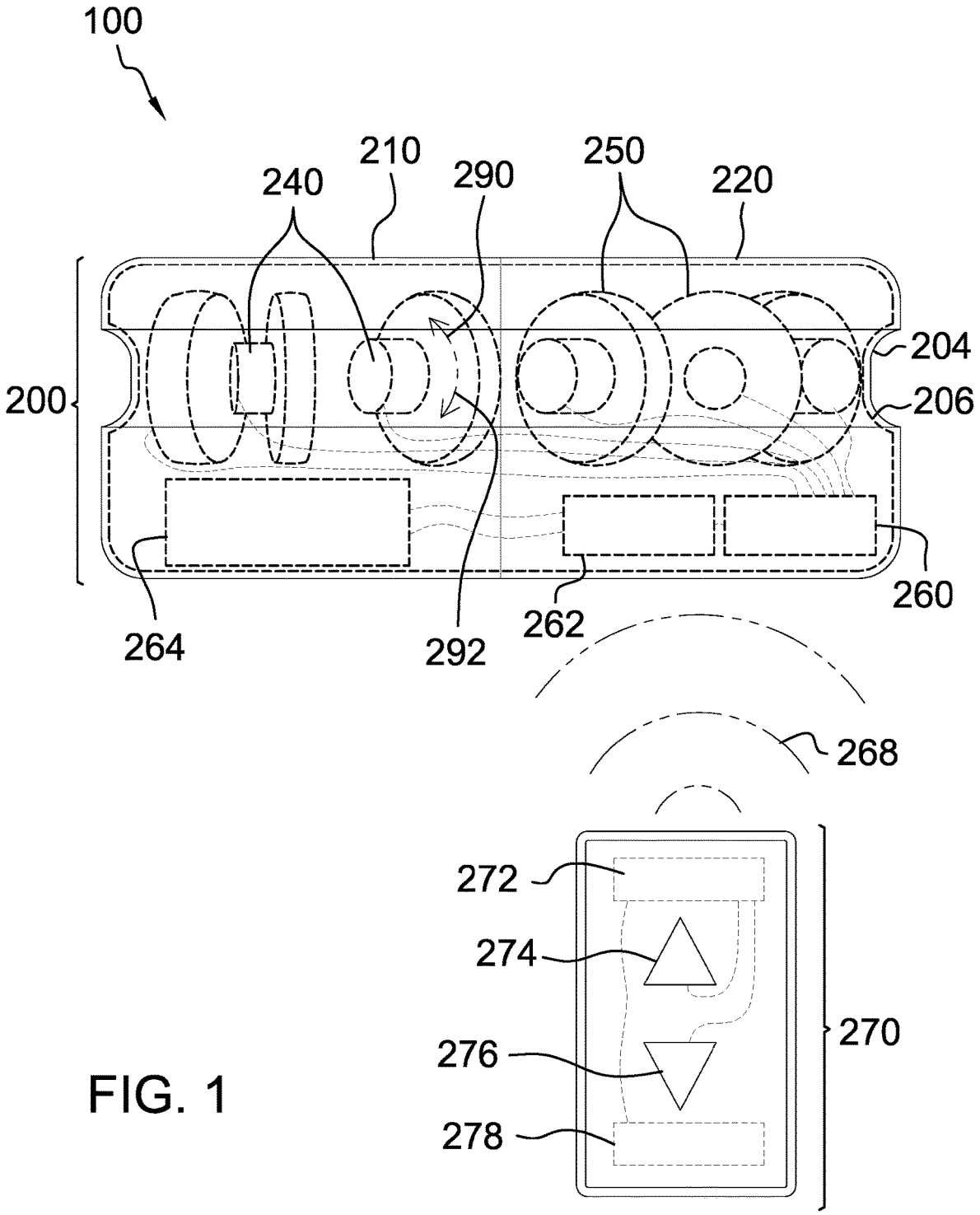
FIG. 1 is a front view of an embodiment of the disclosure.
Figure 2:
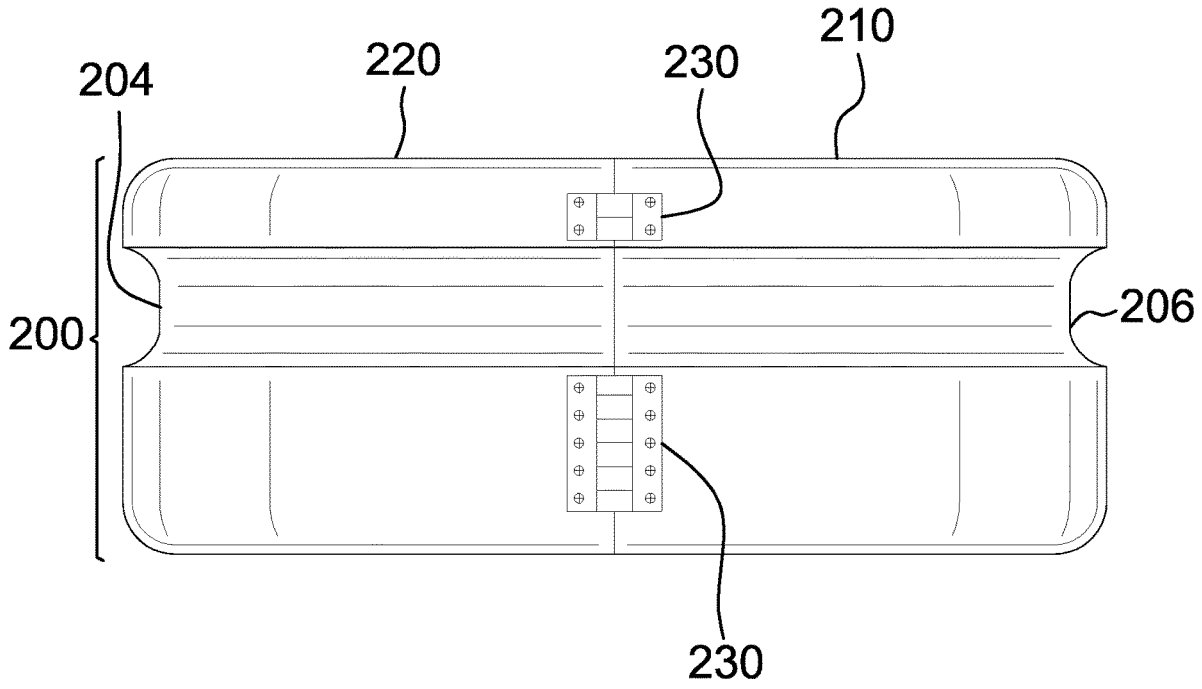
FIG. 2 is a rear view of an embodiment of the disclosure.
Figure 3:
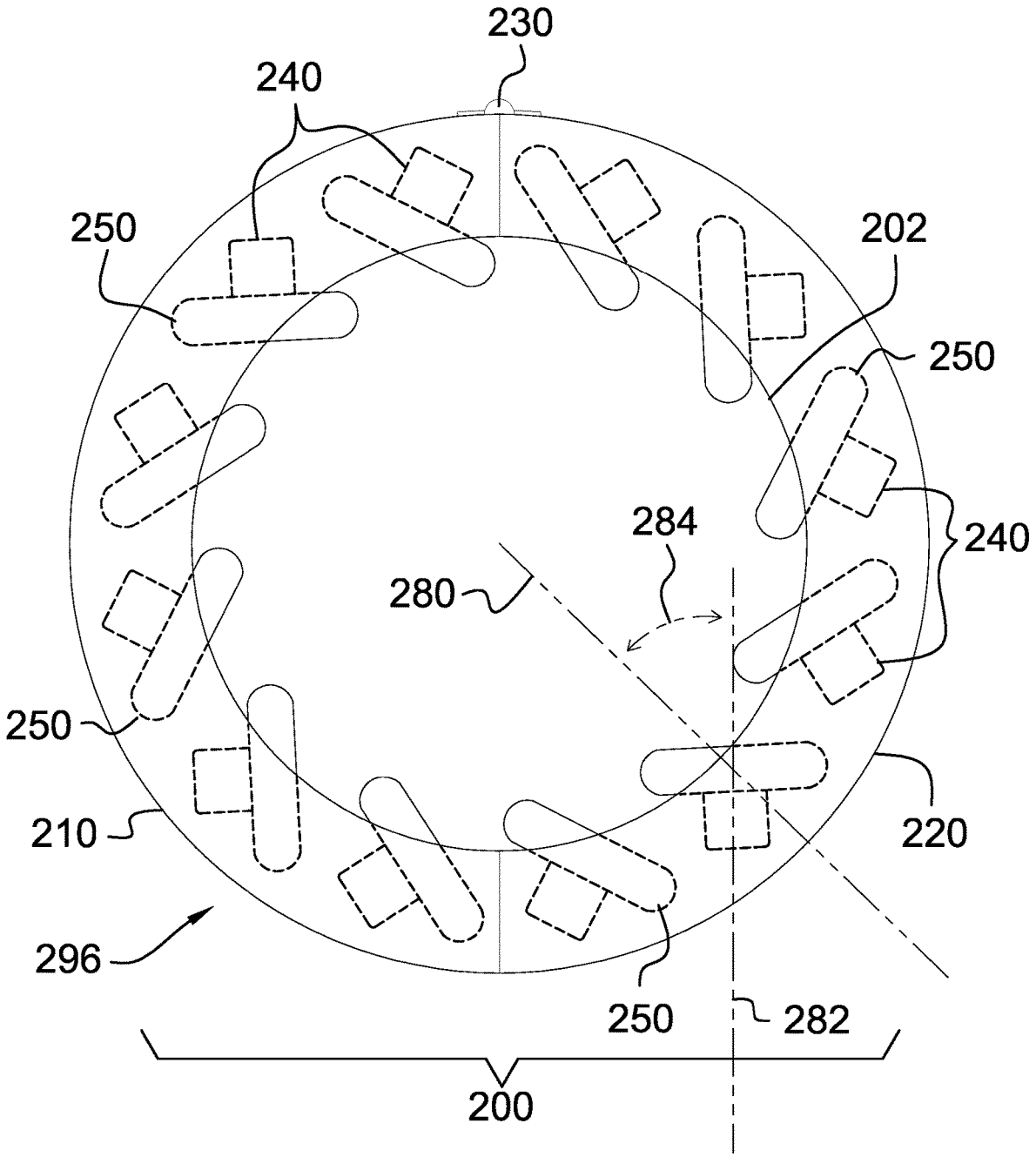
FIG. 3 is a top view of an embodiment of the disclosure illustrating the tree cuff in the closed state.
Figure 4:
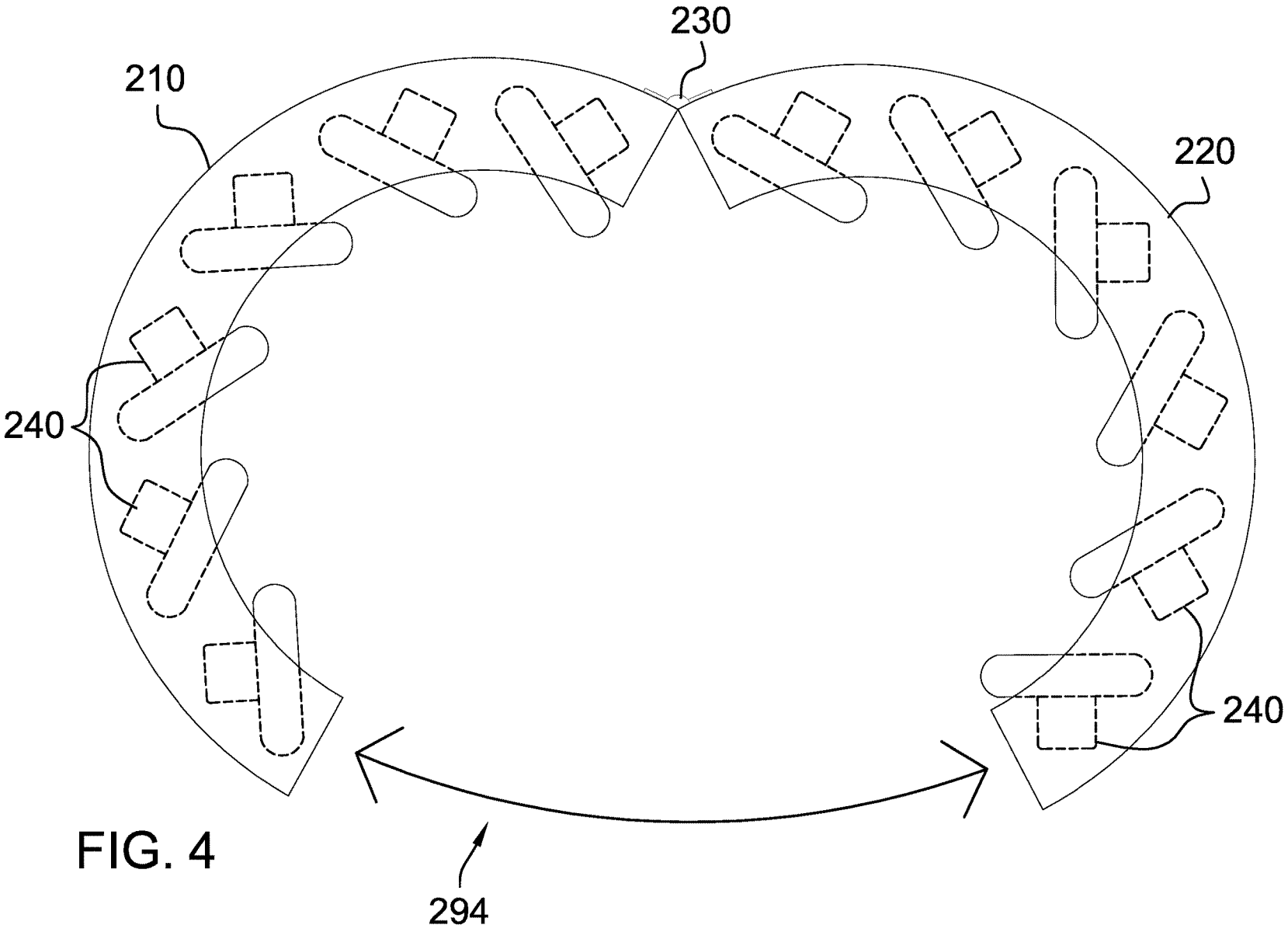
FIG. 4 is a top view of an embodiment of the disclosure illustrating the tree cuff in the open state.
Figure 5:
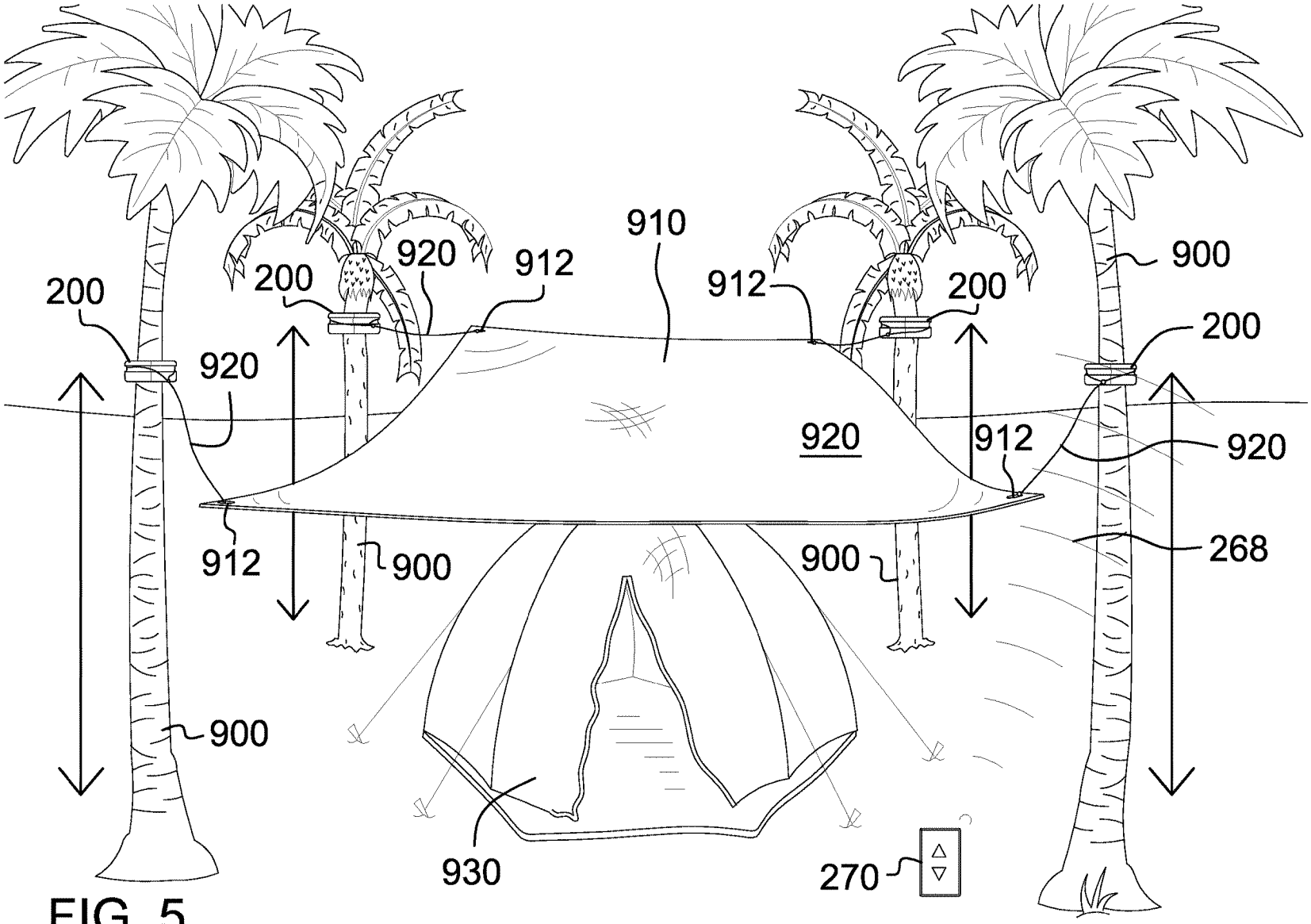
FIG. 5 is an in-use view of an embodiment of the disclosure.

Detailed reference will now be made to a first potential embodiment of the disclosure, which is illustrated in FIGS. 1 through 5.

The tree climbing tarp securing cuff 100 (hereinafter invention) comprises a tree cuff 200, a plurality of wheels 250, a plurality of motors 240, a motor controller 260, and a receiver 262. The tree cuff 200 may climb a trunk of a tree to elevate an end of a rope that is removably coupled to the tree cuff 200. The plurality of wheels 250 may be exposed on the interior of the tree cuff 200 and may be turned by the plurality of motors 240 to propel the tree cuff 200 up and down the trunk. The tree cuffs 200 may be used in groups to suspend a tarp 910 via a plurality of ropes 920. As non-limiting examples, the tree cuffs 200 may suspend the tarp 910 higher than a user can reach to provide shade or to keep rain off of a tent 930 or a picnic table.

The tree cuff 200 may be a 3-dimensional annular ring that may encircle the trunk of the tree. The tree cuff 200 may be horizontally oriented with a tree aperture 202 passing vertically through the center of the tree cuff 200. The trunk may pass through the tree aperture 202 when the tree cuff 200 is coupled to the tree. The tree cuff 200 may comprise a first cuff half 210 and a second cuff half 220. The first cuff half 210 and the second cuff half 220 may be hingedly coupled by one or more cuff hinges 230. The one or more cuff hinges 230 may be operable to pivot the first cuff half 210 and the second cuff half 220 between an open state 294 and a closed state 296. The tree cuff 200 may be placed onto the trunk or removed from the trunk while in the open state 294. The tree cuff 200 may ascend and descend the trunk while in the closed state 296.

The tree cuff 200 may comprise a rope hitch 204. The rope hitch 204 may be operable to removably couple the rope to the tree cuff 200. In a preferred embodiment, the rope hitch 204 may be a rope groove 206. The rope groove 206 may be a circumferential groove surrounding the outside of the tree cuff 200. The rope groove 206 may be operable to prevent the rope from sliding off of the tree cuff 200 when the rope is tied tightly to the tree cuff 200 at the level of the rope groove 206.

The plurality of wheels 250 may be dispersed around the tree cuff 200 with equidistant radial spacing. The plurality of wheels 250 may be operable to propel the tree cuff 200 up and down the trunk when the plurality of wheels 250 are rotated by the plurality of motors 240. In a preferred embodiment, there may be 12 wheels and 12 motors.

The plurality of motors 240 may be coupled to the tree cuff 200. The plurality of motors 240 may be associated with the plurality of wheels 250 in a one-to-one relationship. An individual motor selected from the plurality of motors 240 may be coupled to an individual wheel selected from the plurality of wheels 250.

Each of the individual wheels may be oriented such that a radial 280 from the center of the tree cuff 200 through the center of the individual wheel may intersect an axis of rotation 282 of the individual wheel to form an oblique wheel angle 284.

The plurality of wheels 250 may comprise tires made from a resilient material such that the plurality of wheels 250 may compress to compensate for the diameter of the trunk. As non-limiting examples, the plurality of wheels 250 may comprise solid or hollow pneumatic tires made from natural or synthetic rubber.

The shaft of the individual motor may align with the axis of rotation 282 of the individual wheel that the individual motor is associated with. The individual motor may convert electrical energy into mechanical energy. The individual motor may cause rotation of the individual wheel when the electrical energy is applied to the individual motor. The electrical energy applied to the individual motor may be controlled by the motor controller 260.

The motor controller 260 may energize and de-energize the plurality of motors 240. The motor controller 260 may energize the plurality of motors 240 by applying an electric potential to the plurality of motors 240. The electric potential may be sourced from one or more cuff batteries 264. The motor controller 260 may de-energize the plurality of motors 240 by removing the electric potential from the plurality of motors 240. The plurality of motors 240 may remain stationary when de-energized. The plurality of motors 240 may rotate in a first rotational direction 290 when the electric potential applied by the motor controller 260 has a first polarity. Rotation of the plurality of motors 240 in the first rotational direction 290 may propel the tree cuff 200 upward. The plurality of motors 240 may rotate in a second rotational direction 292 when the electric potential applied by the motor controller 260 has a second polarity. Rotation of the plurality of motors 240 in the second rotational direction 292 may propel the tree cuff 200 downward.

The one or more cuff batteries 264 may comprise one or more energy-storage devices. The one or more cuff batteries 264 may be a source of electrical energy to operate the plurality of motors 240, the receiver 262, and the motor controller 260. The one or more cuff batteries 264 may be rechargeable and/or replaceable.

The motor controller 260 may energize and de-energize the plurality of motors 240 responsive to one or more command signals from the receiver 262. The receiver 262 may receive one or more wireless signals 268 from a remote control unit 270 indicating the state of an UP button 274 and a DOWN button 276. Upon receiving the one or more wireless signals 268 indicating that the UP button 274 is pressed, the receiver 262 may command the motor controller 260 to energize the plurality of motors 240 using the first polarity such that the plurality of motors 240 rotate in the first rotational direction 290 to raise the tree cuff 200. Upon receiving the one or more wireless signals 268 indicating that the DOWN button 276 is pressed, the receiver 262 may command the motor controller 260 to energize the plurality of motors 240 using the second polarity such that the plurality of motors 240 rotate in the second rotational direction 292 to lower the tree cuff 200. In the absence of the one or more wireless signals 268 from the remote control unit 270, the receiver 262 may command the motor controller 260 to de-energize the plurality of motors 240 to hold the tree cuff 200 at a constant height on the trunk.

The remote control unit 270 may be adapted for the user to control the up and down movements of the tree cuffs 200. The remote control unit 270 may comprise a transmitter 272, the UP button 274, the DOWN button 276, and a remote control battery 278 housed within a portable, water-resistant enclosure. The remote control unit 270 may transmit the one or more wireless signals 268 signifying a depression of the UP button 274 when the UP button 274 is pressed and lasting for the duration of the depression of the UP button 274. The remote control unit 270 may transmit the one or more wireless signals 268 signifying a depression of the DOWN button 276 when the DOWN button 276 is pressed and lasting for the duration of the depression of the DOWN button 276.

In some embodiments, the receiver 262 in the tree cuff 200 and the transmitter 272 in the remote control unit 270 may, in fact, both be transceivers. Although the major signaling between the remote control unit 270 and the tree cuff 200 comprises the reporting of button depressions from the remote control unit 270 to the tree cuff 200, bidirectional communications may be necessary for auxiliary functions such as communications pairing.

In use, a tree cuff 200 may be pivoted to the open state 294, placed around the trunk of the tree, and pivoted back to the closed state 296. One end of a rope may be tied around the tree cuff 200 and the other end of the rope may be tied to one of a plurality of corner eyelets 912 of the tarp 910. These steps may be repeated until the plurality of corner eyelets 912 are all coupled to tree cuffs 200 via ropes. As a non-limiting example, four of the tree cuffs 200 may be used to suspend the tarp 910 between a plurality of trees 900. The tree cuffs 200 may be placed on the trunks at the same height above the ground. Alternatively, to assure proper runoff of rainwater, two of the tree cuffs 200 may be placed higher than the rest of the tree cuffs 200 initially. The user may press the UP button 274 to cause the tree cuffs 200 to ascend simultaneously. As the tree cuffs 200 ascend, the tree cuffs 200 may lift the tarp 910. The user may release the UP button 274 once the tarp 910 is above the user.

To retrieve the tarp 910, the user may press the DOWN button 276 causing the tree cuffs 200 descend. Once the tree cuffs 200 have descended to a height where the user may comfortably reach the tree cuffs 200, the user may untie the plurality of ropes 920 from the tree cuffs 200 and remove the tree cuffs 200 from the plurality of trees 900.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

In this disclosure, "compress" may refer to forcing into a smaller space.

As used herein, the words "couple", "couples", "coupled" or "coupling", may refer to connecting, either directly or indirectly, and does not necessarily imply a mechanical connection.

As used herein, "energize" and/or "energization" may refer to the application of an electrical potential to a system or subsystem.

As used herein, an "eyelet" may be a hole intended to receive a string, rope, cord, spring, or hook or a ring intended to reinforce such a hole.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "motor" may refer to a device that transforms energy from an external power source into mechanical energy.

As used in this disclosure, a "motor controller" may be an electrical device that is used to control the speed and/or the direction of rotation of an electric motor based upon one or more inputs.

As used herein, "pair", "paired", and "pairing" may refer to a connection established between two wireless devices or to the process of establishing such a connection.

As used in this disclosure, the term "radial" may refer to a direction which is perpendicular to an identified central axis or which projects away from a center point.

As used herein, "resilient" or "semi-rigid" may refer to an object or material which will deform when a force is applied to it and which will return to its original shape when the deforming force is removed.

As used in this disclosure, "vertical" may refer to a direction that is parallel to the local force of gravity. Unless specifically noted in this disclosure, the vertical direction is always perpendicular to horizontal.

As used in this disclosure, "wireless" may be an adjective that is used to describe a communication channel that does not require the use of physical cabling.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A tree climbing tarp securing cuff comprising:

a tree cuff, a plurality of wheels, a plurality of motors, a motor controller, and a receiver;

wherein the tree cuff climbs a trunk of a tree to elevate an end of a rope that is removably coupled to the tree cuff;

wherein the plurality of wheels are exposed on the interior of the tree cuff and are turned by the plurality of motors to propel the tree cuff up and down the trunk;

wherein the tree cuffs are used in groups to suspend a tarp via a plurality of ropes.

2. The tree climbing tarp securing cuff according to claim 1 wherein the tree cuff is a 3-dimensional annular ring that encircles the trunk of the tree;

wherein the tree cuff is horizontally oriented with a tree aperture passing vertically through the center of the tree cuff;

wherein the trunk passes through the tree aperture when the tree cuff is coupled to the tree.

3. The tree climbing tarp securing cuff according to claim 2 wherein the tree cuff comprises a first cuff half and a second cuff half;

wherein the first cuff half and the second cuff half are hingedly coupled by one or more cuff hinges;

wherein the one or more cuff hinges are operable to pivot the first cuff half and the second cuff half between an open state and a closed state;

wherein the tree cuff is placed onto the trunk or removed from the trunk while in the open state;

wherein the tree cuff ascends and descend the trunk while in the closed state.

4. The tree climbing tarp securing cuff according to claim 3 wherein the tree cuff comprises a rope hitch;

wherein the rope hitch is operable to removably couple the rope to the tree cuff.

5. The tree climbing tarp securing cuff according to claim 4 wherein the rope hitch is a rope groove;

wherein the rope groove is a circumferential groove surrounding the outside of the tree cuff;

wherein the rope groove is operable to prevent the rope from sliding off of the tree cuff when the rope is tied to the tree cuff at the level of the rope groove.

6. The tree climbing tarp securing cuff according to claim 4 wherein the plurality of wheels are dispersed around the tree cuff with equidistant radial spacing;

wherein the plurality of wheels are operable to propel the tree cuff up and down the trunk when the plurality of wheels are rotated by the plurality of motors.

7. The tree climbing tarp securing cuff according to claim 6 wherein there are 12 wheels and 12 motors.

8. The tree climbing tarp securing cuff according to claim 6 wherein the plurality of motors are coupled to the tree cuff.

9. The tree climbing tarp securing cuff according to claim 8 wherein the plurality of motors are associated with the plurality of wheels in a one-to-one relationship;

wherein an individual motor selected from the plurality of motors is coupled to an individual wheel selected from the plurality of wheels.

10. The tree climbing tarp securing cuff according to claim 9 wherein each of the individual wheels are oriented such that a radial from the center of the tree cuff through the center of the individual wheel intersects an axis of rotation of the individual wheel to form an oblique wheel angle.

11. The tree climbing tarp securing cuff according to claim 10 wherein the plurality of wheels comprise tires made from a resilient material such that the plurality of wheels compress to compensate for the diameter of the trunk.

12. The tree climbing tarp securing cuff according to claim 11 wherein the shaft of the individual motor aligns with the axis of rotation of the individual wheel that the individual motor is associated with;

wherein the individual motor converts electrical energy into mechanical energy;

wherein the individual motor causes rotation of the individual wheel when the electrical energy is applied to the individual motor;

wherein the electrical energy applied to the individual motor is controlled by the motor controller.

13. The tree climbing tarp securing cuff according to claim 12 wherein the motor controller energizes and de-energizes the plurality of motors;

wherein the motor controller energizes the plurality of motors by applying an electric potential to the plurality of motors;

wherein the electric potential is sourced from one or more cuff batteries.

14. The tree climbing tarp securing cuff according to claim 13 wherein the motor controller de-energizes the plurality of motors by removing the electric potential from the plurality of motors;

wherein the plurality of motors remain stationary when de-energized.

15. The tree climbing tarp securing cuff according to claim 14 wherein the plurality of motors rotate in a first rotational direction when the electric potential applied by the motor controller has a first polarity;

wherein rotation of the plurality of motors in the first rotational direction propels the tree cuff upward.

16. The tree climbing tarp securing cuff according to claim 15 wherein the plurality of motors rotate in a second rotational direction when the electric potential applied by the motor controller has a second polarity;

wherein rotation of the plurality of motors in the second rotational direction propels the tree cuff downward.

17. The tree climbing tarp securing cuff according to claim 16 wherein the one or more cuff batteries comprise one or more energy-storage devices;

wherein the one or more cuff batteries are a source of electrical energy to operate the plurality of motors, the receiver, and the motor controller;

wherein the one or more cuff batteries are rechargeable and/or replaceable.

18. The tree climbing tarp securing cuff according to claim 17 wherein the motor controller energizes and de-energizes the plurality of motors responsive to one or more command signals from the receiver;

wherein the receiver receives one or more wireless signals from a remote control unit indicating the state of an UP button and a DOWN button;

wherein upon receiving the one or more wireless signals indicating that the UP button is pressed, the receiver commands the motor controller to energize the plurality of motors using the first polarity such that the plurality of motors rotate in the first rotational direction to raise the tree cuff;

wherein upon receiving the one or more wireless signals indicating that the DOWN button is pressed, the receiver commands the motor controller to energize the plurality of motors using the second polarity such that the plurality of motors rotate in the second rotational direction to lower the tree cuff;

wherein in the absence of the one or more wireless signals from the remote control unit, the receiver commands the motor controller to de-energize the plurality of motors to hold the tree cuff at a constant height on the trunk.

19. The tree climbing tarp securing cuff according to claim 18 wherein the remote control unit is adapted for a user to control the up and down movements of the tree cuffs;

wherein the remote control unit comprises a transmitter, the UP button, the DOWN button, and a remote control battery housed within a portable, water-resistant enclosure;

wherein the remote control unit transmits the one or more wireless signals signifying a depression of the UP button when the UP button is pressed and lasting for the duration of the depression of the UP button;

wherein the remote control unit transmits the one or more wireless signals signifying a depression of the DOWN button when the DOWN button is pressed and lasting for the duration of the depression of the DOWN button.

* * * * *